United States Patent [19]

Schuepp

[11] Patent Number: 4,765,266

[45] Date of Patent: Aug. 23, 1988

[54] SHUTTLE EMBROIDERING MACHINE

[75] Inventor: Egon Schuepp, Romanshorn, Switzerland

[73] Assignee: Aktiengesellschaft Adolf Saurer, Arbon, Switzerland

[21] Appl. No.: 94,008

[22] Filed: Sep. 8, 1987

[30] Foreign Application Priority Data

Sep. 11, 1986 [CH] Switzerland ..... 3656/86

[51] Int. Cl.[4] ..... D05C 15/00

[52] U.S. Cl. ..... 112/90

[58] Field of Search ..... 112/90, 86, 102

[56] References Cited

U.S. PATENT DOCUMENTS

| | | | |
|---|---|---|---|
| 1,257,271 | 2/1918 | Bloch et al. | 112/90 |
| 2,253,380 | 8/1941 | Knowland et al. | 112/9 |
| 3,183,866 | 5/1965 | Walbert et al. | 112/90 |
| 4,098,203 | 7/1978 | Job | 112/90 |

*Primary Examiner*—Ronald Feldbaum

*Attorney, Agent, or Firm*—Werner W. Kleeman

[57] ABSTRACT

The embroidering frame of the shuttle embroidering machine comprises cloth beams drivable via drive means. The cloth beams coact in pairs to receive between each such pair a respective material web. These material webs are superimposed in the frame plane and at each material web there engages at each longitudinal edge of the web material a rod-shaped temple or spreader. The upper and lower cloth beams both for the upper and lower material webs are each in selective driving connection by a respective endless belt of the drive means with the driving shaft of an associated geared motor of the drive means and which is carried by the embroidering frame. A belt tensioning device which is reversibly switchable with the rotation direction of the associated geared motor is used. The control circuit of the geared motors contains switching means for the selective separate or synchronous operation of the two geared motors. These measures ensure a beaming or winding-on of the individual not yet embroidered material webs and a synchronous rebeaming or winding-up of the embroidered material webs in a simple and operationally reliable manner.

6 Claims, 1 Drawing Sheet

SHUTTLE EMBROIDERING MACHINE

BACKGROUND OF THE INVENTION

The present invention relates to a new and improved construction of a shuttle embroidering or embroidery machine.

Generally speaking, the shuttle embroidering machine of the present development is of the type containing an embroidering or embroidery frame having a frame plane and containing cloth beams drivable via drive means. The cloth beams are arranged in coacting pairs and each cloth beam pair serves for receiving a material web therebetween and the material webs are arranged in superimposed manner in the frame plane. A respective rod-like temple or spreader or stretcher means engages at each longitudinal edge of the web material.

Embroidering machines of this type require, among other things, considerable technical effort and expenditure for beaming or winding-on the material webs to be embroidered onto the embroidering frame, as well as for rebeaming or winding-up the embroidered material.

In earlier times, use was made of manually operated transmission or gear means mounted at the individual cloth beams, or in place of a hand crank there was made use of a position-adjustable motor, but of late devices have become known in which the drive means comprise compressed air motors which are carried by the embroidering frame and which are in fixed driving connection with the cloth beams.

When undertaking an appreciable expenditure for the control means, these prior art devices working with compressed air motors admittedly permit an individual or separate drive of the cloth beams for beaming or a winding-on the unembroidered material webs or a synchronous drive thereof for rebeaming or winding-up the embroidered material webs, but suffer from considerable disadvantages. In particular, serious damage can occur in the case of blockages as a result of the positive or form-looking connection between the drive means and the cloth beams. Moreover, compressed air motors require an additional driving or propellant medium with correspondingly complicated installations, while the control of the compressed air motors is problematical.

SUMMARY OF THE INVENTION

Therefore, with the foregoing in mind, it is a primary object of the present invention to provide a new and improved construction of a shuttle embroidering machine which does not exhibit the aforementioned drawbacks and shortcomings of the prior art constructions.

Another significant object of the present invention is to design a shuttle embroidering machine of the aforementioned type, in such a way that both beaming and rebeaming of the individual webs of material on or at the embroidering frame can be performed in an optimum, constructionally simple and operationally reliable manner.

Yet a further noteworthy object of the present invention aims at providing a new and improved construction of a shuttle embroidering machiine which is relatively simple in construction and design, extremely reliable in operation, relatively economical to manufacture, not readily subject to breakdown or malfunction and requires a minimum of maintenance and servicing.

Now in order to implement these and still further objects of the present invention, which will become more readily apparent as the description proceeds, the shuttle embroidering machine of the present development is manifested by the features that the upper cloth beam and the lower cloth beam both for the upper web of material and for the lower web of material, respectively, are each in selective driving connection by means of a respective associated endless belt with the driving shaft of an associated geared motor carried by the embroidering frame. Furthermore, there is used for each cloth beam pair an associated belt tensioning device which is switchable or reversible with the rotation direction of the related or associated geared motor, and in the control circuit for the geared motors there are switch means for an individual or synchronous operation or actuation of the two geared motors.

As a result of these measures, there is first of all obtained a simple design with regard to construction and control and this is due to the use of electric motors. Additionally, as a result of the connection by frictional engagement between predeterminate components or elements of the drive means and the cloth beams, safety and reliability are improved. In addition, beaming and rebeaming can take place independently of the momentary vertical position of the embroidering frame. During rebeaming or winding-up of the embroidered web material, a simple rotation direction change of the drive or geared motors enables the material webs to be reversed, e.g. for removing a fault.

In order to optimize the connection by frictional engagement between the drive means and the cloth beams, it is advantageous if each reversible or switchable belt tensioning device comprises a selectively actuatable or switchable belt tensioning lever or equivalent structure operatively associatable with one or the other endless belt of the related pair of cloth beams. By means of a slip clutch with adjustable torque or rotational moment the belt tensioning lever rests on the free end of the driving shaft of the related drive or geared motor.

In order to prevent faulty control operations and therefore a movement of the one or the other material web during the embroidering process, it is appropriate if current interrupters or interrupter switches are arranged in the control circuit for the drive or geared motors and are in operative connection with substantially rod-like temples or stretchers or spreaders located on each longitudinal edge of the upper and lower material webs.

The invention also relates to a novel technique or method for operating the embroidering or embroidery machine according to the invention, in which the transport or conveying of the upper web of material or lower web of material by means of the drive or geared motors during rebeaming or winding-up of the material webs is carried out at a speed which is equal to or lower than the vertical adjustment speed of the embroidering frame. Thus, even during rebeaming, the embroidery needles can be left in the material without them being able to tear out.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
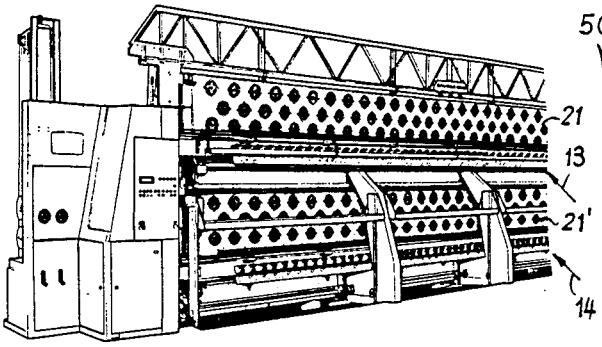
FIG. 1 shows a diagrammatic partial view of a modern large shuttle embroidering or embroidery machine.
Figure 4:
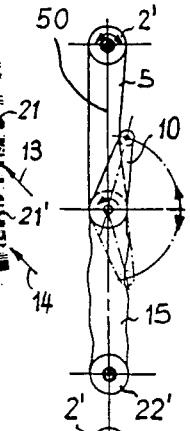
FIG. 4 shows in detail, a front partial view of the driving belts and belt tensioning devices of the arrangement according to FIG. 1.
Figure 2:
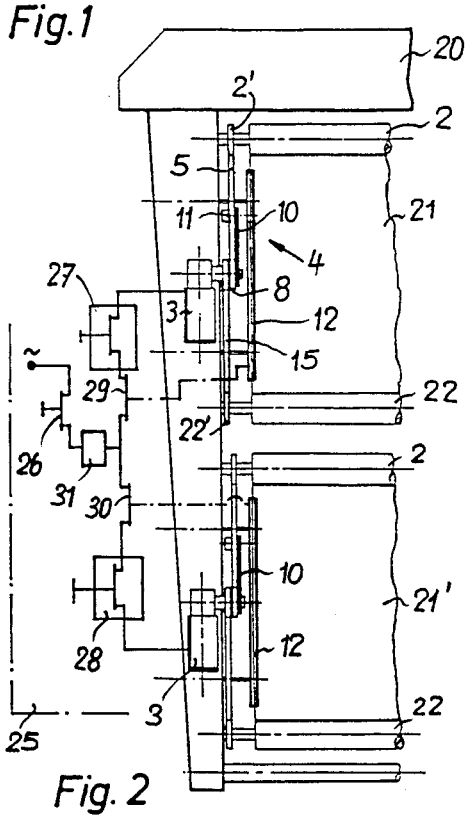
FIG. 2 shows a rear partial view on a larger scale of the embroidering or embroidery frame of the machine according to FIG. 1.

Describing now the drawings, it is to be understood that to simplify the showing thereof, only enough of the structure of the shuttle embroidering or embroidery machine has been illustrated therein as is needed to enable one skilled in the art to readily understand the underlying principles and concepts of the present invention. Turning now specifically to FIG. 1 of the drawings, the shuttle embroidering machine illustrated therein by way of example and not limitation, will be seen to produce, for instance, two substantially vertically superimposed material webs 21 and 21', which in known manner, are embroidered by upper and lower rows of suitable embroidery needles, as schematically generally indicated by reference numerals 13 and 14, respectively. The material webs or webs of material 21 and 21' are wound onto associated cloth beams 2 and 22, respectively, which are supported on the machine embroidering frame 20, as shown in FIG. 2 and as will be described in greater detail hereinafter. The frame 20 has a frame plane, generally indicated in FIGS. 2 and 4 by reference numeral 50, and in which there are substantially located the coacting pairs of cloth beams 2 and 22 and the associated material webs 21 and 21', respectively.

For the individual motor rotation of the cloth beams 2 and 22 for the beaming or winding-on of the particular material webs 21 and 21' which have not yet been embroidered or for the synchronous motor rotation for rebeaming or winding-up of the embroidered material webs, in each case, the upper and lower cloth beams 2 and 22 of each pair, both for the upper material web 21 and the lower material web 21', respectively, are in selective driving or drive connection by means of, in each case, suitable power transmitting elements here shown as an endless belt 5 and 15, respectively, with the driving or drive shaft 7 of an associated reversible drive or geared motor 3 carried by the embroidering frame 20. Furthermore, there is provided for each pair of cloth beams 2 and 22 a belt tensioning device 4 which is switchable as a function of the rotation direction of the associated drive or geared motor 3, as can in particular be seen from FIG. 4.

The endless belts 5 and 15 of each pair of cloth beams 2 and 22 are preferably V-belts which, in the untensioned and therefore inactive state, loosely loop or train around corresponding V-belt pulleys 2' and 22' arranged on the bearing shaft of the related cloth beam 2 and 22 or the related twin belt pulley 8 on the driving or drive shaft 7 of the relevant drive or geared motor 3.

Figure 3:
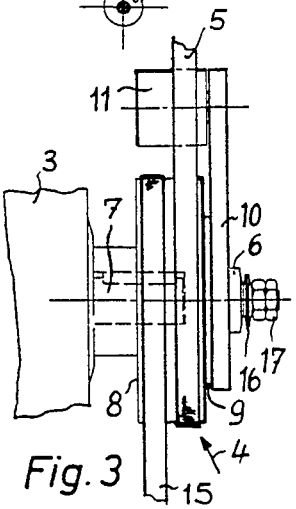
FIG. 3 shows in detail and on a larger scale one of the belt tensioning devices of the arrangement according to FIG. 1.

For tensioning the upper V-belt 5 or the lower V-belt 15 for a forward transport or return transport, respectively, of the upper material web 21 or lower material web 21', the related belt tensioning device 4 comprises a switchable or actuatable belt tensioning lever 10 which can be operatively engaged with the one endless belt 5 or the other endless belt 15 of the related pair of cloth beams 2 and 22. Each belt tensioning lever 10 is seated by means of a slip clutch 9, 16 and 17 with adjustable torque or rotational moment on the free end 7*a* of the driving or drive shaft 7 of the related drive or geared motor 3, as is shown in greater detail in FIG. 3. For this purpose, each belt tensioning lever 10, which preferably carries at its free end 7*a* an idler pulley or tensioning roll 11, engages or bears at an associated friction plate 9 rigidly connected for rotation with the driving or drive shaft 7 under the action of a regulatable compression or pressure spring 16 which is adjustable by means of regulating or adjustment nuts 17 or equivalent structure.

This arrangement is characterized by a very simple design and maximum operational reliability, while also permitting retrofitting of existing embroidering or embroidery machines.

The selective control of the two drive or geared motors 3 in the forward direction or return direction, either individually or synchronously, takes place by means of a control circuit 25 according to FIG. 2. The master or main switch 26 of the control circuit 25 is followed by a rotation direction reversing switch 31, as well as individual switches 27 and 28 for both drive or geared motors 3. These switches can be provided at desired or random points on the machine for the operation thereof. If both the individual switches 27 and 28 are closed, there takes place synchronous running of the drive or geared motors 3. It is naturally possible to provide further synchronous running circuits in the control circuit 25 for optimizing synchronous running.

In order to prevent the switching on or activation of the drive or geared motors 3 during the embroidering process or operation, current interrupters or interrupter switches 29 and 30 are provided in the control circuit 25 of the drive or geared motors 3 and are in operative connection with the rod-like temples or spreaders 12 arranged on each longitudinal edge of the upper material web 21 and lower material web 21', respectively, as shown particularly well in FIG. 2. This ensures that a web advance or feed can only take place at the related material web 21 and 21' if the temples or spreaders 12 are inoperative.

Obviously, further or different safety circuits can be incorporated into the overall control circuit 25 together with optical and/or acoustic monitoring and signalling means.

Thus, a shuttle embroidering machine is provided, which is now able to satisfy all the aforementioned requirements.

To meet differing embroidering requirements and in order to be able to leave the embroidery needles in the material during rebeaming or winding-up of the embroidered material without any tearing out thereof, the drive or geared motors 3 and control circuit 25 are constructed according to the invention such that the transport of the upper material web 21 and lower material web 21', respectively, by means of the drive or geared motors 3 is carried out during rebeaming or winding-up of the embroidered material at a speed which is equal to or lower than the vertical adjustment speed of the embroidery frame 20. Furthermore, due to the use of reversible drive or geared motors 3 the beaming or winding-on of the web of material not yet embroidered and received from a suitable supply can be accomplished either at the upper cloth beam 2 or lower cloth beam 22 of each pair as desired.

While there are shown and described present preferred embodiments of the invention, it is to be distinctly understood that the invention is not limited thereto, but may be otherwise variously embodied and practiced within the scope of the following claims. Accordingly,

What I claim is:

1. A shuttle embroidering machine, comprising:

an embroidering frame having a frame plane;

cloth beams provided for said embroidering frame;

drive means for driving said cloth beams;

said cloth beams being arranged in coacting pairs;

each coacting pair of cloth beams serving for receiving therebetween a material web;

said material webs being arranged in superimposed manner in substantially the frame plane;

substantially rod-like temples engaging each material web at a longitudinal edge thereof;

each said coacting pair of cloth beams defining an upper cloth beam and a lower cloth beam;

said two material webs defining an upper material web and a lower material web;

said drive means comprising a respective geared motor provided for each said upper cloth beam and said lower cloth beam;

each geared motor having an associated driving shaft;

each geared motor being carried by the embroidering frame;

said drive means further including a respective pair of endless belts provided for each said upper cloth beam and lower cloth beam;

said upper cloth beam and said lower cloth beam for the respective upper material web and the lower material web being in selective driving connection by means of an associated endless belt of the respective pair of endless belts with the driving shaft of the associated geared motor;

a switchable belt tensioning device provided for each cloth beam and operatively reversible with the rotation direction of the geared motor of the associated cloth beam;

a control circuit provided for the geared motors; and switch means provided in the control circuit for the geared motors for selectively accomplishing an individual or synchronous operation of the geared motors.

2. The shuttle embroidering machine as defined in claim 1, wherein:

each said switchable belt tensioning device comprises a belt tensioning lever;

each said driving shaft of each said geared motor having a free end;

a respective slip clutch means possessing an adjustable torque provided for each geared motor;

each said belt tensioning lever of each cloth beam being selectively switchable into operative association with the one or other of said endless belts of the associated cloth beam; and each of said belt tensioning levers being seated by means of an associated one of said slip clutch means upon the free end of the drive shaft of the related geared motor.

3. The shuttle embroidering machine as defined in claim 1, wherein:

said control circuit of said geared motors comprises current interrupters; and said current interrupters of the control circuit of said geared motors being in operative connection with said substantially rod-like temples on each longitudinal edge of the upper material web and lower material web.

4. The shuttle embroidering machine as defined in claim 1, wherein:

said geared motors transport the upper material web and the lower material web during winding-up of the embroidered material webs at a speed which is equal to a substantially vertical adjustment speed of the embroidering frame.

5. The shuttle embroidering machine as defined in claim 1, wherein:

said geared motors transport the upper material web and the lower material web during winding-up of the embroidered material webs at a speed which is greater than a substantially vertical adjustment speed of the embroidering frame.

6. A shuttle embroidering machine, comprising:

an embroidering frame having a frame plane;

cloth beam means provided for said embroidering frame;

drive means for driving said cloth beam means;

each cloth beam means serving for transporting a respective material web;

said cloth beam means being arranged in substantially superimposed manner in substantially the frame plane;

said cloth beam means defining an upper cloth beam and a lower cloth beam;

said material webs defining an upper material web and a lower material web;

said drive means comprising a respective reversible drive motor provided for each said upper cloth beam and said lower cloth beam;

said drive means further including a respective pair of power transmitting elements provided for each said upper cloth beam and lower cloth beam;

said upper cloth beam and said lower cloth beam for the respective upper material web and the lower material web being in selective driving connection by means of a predeterminate one of the power transmitting elements of the associated pair of power transmitting elements with the associated reversible drive motor of the upper cloth beam or lower cloth beam;

a respective switchable belt tensioning device provided for the upper cloth beam and the lower cloth beam and operatively reversible with the rotation direction of the reversible drive motor of the associated upper cloth beam or lower cloth beam in order to be selectively placed into coacting relationship with a predeterminate one of said pair of power transmitting elements of the associated upper cloth beam or lower cloth beam;

a control circuit provided for the drive motors; and means provided in the control circuit for the drive motors for selectively accomplishing an individual or synchronous operation of the drive motors.

* * * * *